US005931257A

United States Patent [19]

Harden

[11] Patent Number: 5,931,257

[45] Date of Patent: Aug. 3, 1999

[54] SCAFFOLD STEP

[76] Inventor: Danny Harden, HC 51D, Holliday, Tex. 76366

[21] Appl. No.: 09/122,328

[22] Filed: Jul. 24, 1998

[51] Int. Cl.[6] ..... E06C 7/00

[52] U.S. Cl. ..... 182/92; 182/90

[58] Field of Search ..... 182/90, 92, 127, 182/222; 248/230.4; 280/163, 166

[56] References Cited

U.S. PATENT DOCUMENTS

| | | |
|---|---|---|
| 693,037 | 2/1902 | Lemon . |
| 1,134,032 | 3/1915 | Clarke . |
| 1,157,083 | 10/1915 | Clarke . |
| 1,285,817 | 11/1918 | Sklar . |
| 1,509,022 | 9/1924 | Noble . |
| 2,226,489 | 12/1940 | Doherty . |
| 4,056,270 | 11/1977 | Greenfield . |
| 4,903,795 | 2/1990 | Cummings . |
| 4,943,076 | 7/1990 | Tripke . |
| 5,111,908 | 5/1992 | Reiter et al. . |
| 5,702,082 | 12/1997 | Evans . |
| 5,732,996 | 3/1998 | Graffy ..... 280/166 |

FOREIGN PATENT DOCUMENTS

| | | |
|---|---|---|
| 2454511 | 12/1980 | France . |
| 651677 | 4/1951 | United Kingdom . |

*Primary Examiner*—Alvin Chin-Shue
*Attorney, Agent, or Firm*—Stephen R. Greiner

[57] ABSTRACT

A scaffold step including an elongated platform and a number of clamps disposed at spaced-apart positions along the length of the elongated platform. The elongated platform has an openwork construction which sheds dirt and moisture and provides a non-slip surface for standing. Each of said clamps, however, includes hinged, upper and lower members which may be clamped around a tubular scaffold member by means of a simple, nut and bolt arrangement.

3 Claims, 1 Drawing Sheet

SCAFFOLD STEP

FIELD OF THE INVENTION

The present invention relates generally to a readily-detachable, independent step or rung for use with scaffolds, ladders, fire escapes and the like.

BACKGROUND OF THE INVENTION

Scaffolds are commonly used for supporting workmen and materials during the construction or repair of a building. The typical scaffold is made of tubular members arranged horizontally and vertically so as to form a three-dimensional framework. To reach the upper portions of the scaffold, workmen typically climb from one horizontal member to the next. Since the tubular members do not offer a particularly secure footing to climbers, slip-and-fall injuries are common.

In an effort to eliminate harm of this sort, independent steps for attachment to a single horizontal member of a scaffold have been proposed. It is believed that these steps have not received widespread acceptance since they have had a tendency to rotate upon the tubular scaffold members to which they are fastened. Thus, a workman may tread upon a properly installed, prior art scaffold step only to have it rotate and throw him to the ground.

SUMMARY OF THE INVENTION

In light of the problems associated with the known scaffold steps, it is a principal object of the invention to provide a stable supporting surface that can be quickly clamped on a horizontal, tubular member of a scaffold and that will not move once clamped in place.

It is an object of the invention to provide improved elements and arrangements thereof in a scaffold step for the purposes described which is lightweight in construction, inexpensive in manufacture, and durable in use.

Briefly, the scaffold step in accordance with this invention achieves the intended objects by featuring an elongated platform having a number of clamps disposed at spaced-apart positions along its length. The elongated platform has an openwork construction which sheds dirt and moisture and provides a non-slip surface for standing. Each of said clamps includes hinged, upper and lower members which may be clamped around a tubular scaffold member by means of a nut and bolt.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
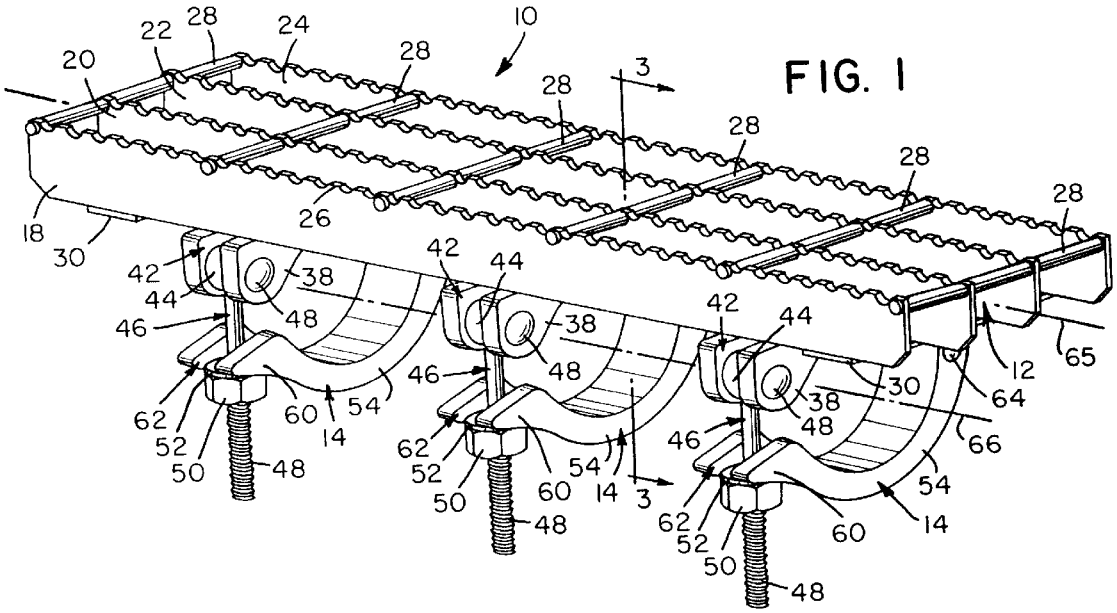
FIG. 1 is a perspective view of a scaffold step in accordance with the present invention.
Figure 2:
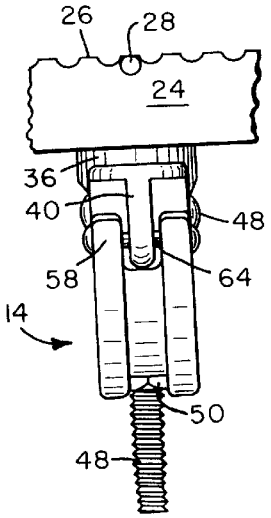
FIG. 2 is a rear elevational view of one of the clamps forming part of the scaffold step.
Figure 3:
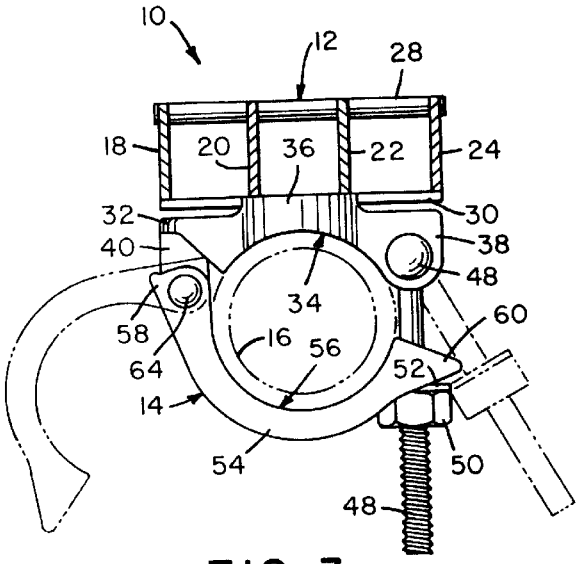
FIG. 3 is a cross-sectional view taken along line 3—3 of FIG. 1.

Referring now to the FIGS., a scaffold step in accordance with the present invention is shown at 10. The step 10 includes an elongated platform 12 having a number of clamps 14 secured to the bottom thereof for attachment to a cylindrical member 16 of a scaffold. For strength, the platform 12 and clamps 14 are preferably formed of steel or other metal alloy.

The platform 12 includes four, support plates 18, 20, 22 and 24 having teeth 26 projecting from their upper surfaces to prevent the slipping of a user standing on the platform. The plates 18, 20, 22 and 24 are retained in a spaced-apart relationship by a plurality of connecting rods 28 and arms 30. Each of the rods 28 is welded to the respective upper ends of the plates 18, 20, 22 and 24 at positions where the teeth 26 have been substantially removed. (Since the rods 28 are provided with a size like that of the missing teeth, the non-slip quality of the platform 12 is not impaired.) Each of the arms 30, however, is welded to a respective one of the lower ends of the plates 18, 20, 22 and 24.

Each clamp 14 includes an upper member 32 with a concave portion 34 for engagement with the top of scaffold member 16. Extending upwardly from the center of the concave portion 34 is an attachment portion 36 which is welded to the interior plates 20 and 22 of the platform 12. Extending downwardly from the opposite ends of the concave portion 34 are apertured flanges 38 and 40. Preferably, the flange 38 is bisected by a vertical slot 42.

Within the vertical slot 42 is positioned the apertured head 44 of an eye bolt 46. A hinge pin 48 extends through the flange 38 and head 44 to pivotally secure the eye bolt 46 to the upper member 32. Extending from the head 44 is a threaded shaft 48 to which a mated nut 50 and washer 52 are fastened.

Each clamp 14 also includes a lower member 54 with a concave portion 56 for engagement with the bottom of scaffold member 16. Extending upwardly from one end of the concave portion 54 is a vertically-slotted and apertured flange 58. At the end of the concave portion 54 opposite the flange 58 is another flange 60 which has been bisected by a vertical slot 62.

By means of a hinge pin 64 extending through the flanges 58 and 40, the member 54 is secured to the member 32. When the threaded shaft 48 of the bolt 46 is positioned in the slot 62, the nut 50 may be tightened against the flange 60 to drive the members 32 together 54 and secure them firmly to the scaffold member 16. Because the longitudinal axis 65 of the platform 12 and the central axes 66 of the clamps 14 are parallel, the platform 12 can be secured in a stabile manner to a single scaffold member 16.

A user is not restricted to using one step 10 on one scaffold. From the foregoing, it should be apparent that a number of steps 10 can be readily mounted on a scaffold at any one time. When the steps 10 are mounted on scaffold members 16 which are located one above the other a safe flight of steps is built.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A scaffold step for mounting on a tubular scaffold member, said scaffold step comprising:

an elongated platform having a longitudinal axis and including:

a plurality of support plates positioned in a side-by-side relationship, each of said support plates having an upper end and a lower end and a plurality of teeth in said upper end for gripping the footwear of a user treading thereon;

a plurality of connecting rods piercing said teeth and being fixedly secured across the upper ends of said support plates; and, a plurality of connecting arms fixedly secured across the lower ends of said support plates;

a plurality of clamps disposed at spaced-apart positions along said elongated platform, each of said clamps having a central axis oriented parallel to said longitudinal axis of said elongated platform, each of said clamps including:

an upper member fixedly secured to the bottom of said elongated platform, said upper member having a first flange, a second flange, and a first concave portion between said first flange and said second flange for engagement with the top of a tubular scaffold member;

a lower member having a third flange, a fourth flange, and a second concave portion between said third flange and said fourth flange for engagement with the bottom of a tubular scaffold member, said third flange having a vertical slot and said fourth flange being hingedly secured to said second flange of said upper member;

an eye bolt hingedly secured to said first flange of said upper member and adapted for positioning within said slot in said third flange of said lower member; and, a nut threaded onto said eye bolt for engaging said third flange of said lower member and for providing a clamping effect on a tubular scaffold member positioned between said first concave portion and said second concave portion.

2. The scaffold step according to claim 1 wherein said support plates, said connecting rods, and said connecting arms are formed of metal and are fixedly secured together by welding.

3. A scaffold step for mounting on a tubular scaffold member, said scaffold step comprising:

an elongated platform having a longitudinal axis and including:

a plurality of support plates positioned in a side-by-side relationship, each of said support plates having an upper end and a lower end and a plurality of teeth in said upper end for gripping the footwear of a user treading thereon;

a plurality of connecting rods piercing said teeth and being fixedly secured across the upper ends of said support plates; and, a plurality of connecting arms fixedly secured across the lower ends of said support plates;

a plurality of clamps disposed at spaced-apart positions along said elongated platform, each of said clamps having a central axis oriented parallel to said longitudinal axis of said elongated platform, each of said clamps including:

an upper member fixedly secured to the bottom of the lower ends of at least two support plates, said upper member having a first flange, a second flange, and a first concave portion between said first flange and said second flange for engagement with the top of a tubular scaffold member;

a lower member having a third flange, a fourth flange, and a second concave portion between said third flange and said fourth flange for engagement with the bottom of a tubular scaffold member, said third flange having a vertical slot and said fourth flange being hingedly secured to said second flange of said upper member;

an eye bolt hingedly secured to said first flange of said upper member and adapted for positioning within said slot in said third flange of said lower member; and, a nut threaded onto said eye bolt for engaging said third flange of said lower member and for providing a clamping effect on a tubular scaffold member positioned between said first concave portion and said second concave portion.

* * * * *